US012241207B1

(12) United States Patent
Haydu et al.

(10) Patent No.: US 12,241,207 B1
(45) Date of Patent: Mar. 4, 2025

(54) SYSTEM AND METHOD FOR WATERPROOFING RAILWAY STRUCTURES

(71) Applicant: Freedom Chemical Corporation, Foothill Ranch, CA (US)

(72) Inventors: Jonathan Wolff Haydu, San Diego, CA (US); Kyle David Flanagan, Rancho Santa Margarita, CA (US)

(73) Assignee: Freedom Chemical Corporation, Foothill Ranch, CA (US)

( * ) Notice: Subject to any disclaimer, the term of this patent is extended or adjusted under 35 U.S.C. 154(b) by 0 days.

(21) Appl. No.: 18/776,822

(22) Filed: Jul. 18, 2024

(51) Int. Cl.
*E01B 19/00* (2006.01)

(52) U.S. Cl.
CPC ..... *E01B 19/00* (2013.01)

(58) Field of Classification Search
CPC . E01B 1/00; E01B 1/008; E01B 19/00; E01B 19/006
See application file for complete search history.

(56) References Cited

U.S. PATENT DOCUMENTS

| | | | |
|---|---|---|---|
| 4,151,025 | A | 4/1979 | Melvin |
| 4,233,356 | A | 11/1980 | Jacobs |
| 4,774,795 | A | 10/1988 | Braun |
| 5,185,013 | A | 2/1993 | Martin |
| 6,450,729 | B1 | 9/2002 | Clapp |
| 6,619,879 | B1 | 9/2003 | Scuero |
| 7,597,503 | B2 | 10/2009 | Hinding |
| 8,499,394 | B1 | 8/2013 | Haydu |
| 8,826,481 | B1 | 9/2014 | Haydu |
| 9,234,321 | B2 | 1/2016 | Haydu |
| 9,441,335 | B2 | 9/2016 | Haydu |
| 9,869,065 | B2 | 1/2018 | Haydu |
| 9,995,010 | B2 | 6/2018 | Haydu |
| 10,036,131 | B2 | 7/2018 | Pascetta |
| 10,132,049 | B2 | 11/2018 | Haydu |
| 10,184,243 | B2 | 1/2019 | Hamilton |
| 10,415,197 | B2 * | 9/2019 | Haydu ..... E01B 2/003 |
| 10,612,198 | B2 | 4/2020 | Haydu |
| 2015/0113745 | A1 | 4/2015 | Haydu |
| 2016/0115657 | A1 | 4/2016 | Haydu |
| 2018/0106001 | A1 | 4/2018 | Robinson |
| 2018/0127931 | A1 | 5/2018 | Pascetta |

FOREIGN PATENT DOCUMENTS

| | | | |
|---|---|---|---|
| KR | 101036277 | B1 | 5/2011 |
| KR | 102174938 | B1 | 11/2020 |
| KR | 102286256 | B1 | 8/2021 |

* cited by examiner

*Primary Examiner* — Robert J McCarry, Jr.
(74) *Attorney, Agent, or Firm* — Knobbe, Martens, Olson & Bear, LLP

(57) ABSTRACT

A waterproofing structure for a railway structure includes a waterproof membrane that is applied over a bed of the railway structure, and a membrane protection layer that is applied over the waterproof membrane. The membrane protection layer is an elastomeric foam that excludes a filler material. The membrane protection layer can be a polyurea foam applied as a single layer.

20 Claims, 2 Drawing Sheets

SYSTEM AND METHOD FOR WATERPROOFING RAILWAY STRUCTURES

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field

The present disclosure is directed to waterproofing of railway structures, and more particularly to waterproofing railway structures with a spray applied protection layer that excludes a filler material (e.g., granulated rubber).

Description of the Related Art

Railway structures, such as railroad bridge decks, can deteriorate, for example from temperature and weather cycles, loading and unloading cycles when trains pass over them, as well as from corrosion. Additionally, railway structures experience contraction and expansion, due to temperature cycles during the day and weather changes during the year, which can result in their deterioration over time. Railroad structures use a ballast or ballast rock to provide stability to the railroad tracks. However, ballast rock traps water and keeps it on the bridge deck. Waterproofing of railroad structures is intended to protect the bridge deck from corrosion and/or deterioration due to the presence of water However, existing waterproofing systems are complex and require several steps and specialized equipment to apply, which makes waterproofing applications more time consuming, costly and require specialized training of personnel. One existing waterproofing system includes spraying a mixture incorporating granulated rubber onto a ballast mat, but requires application of an additional sealing layer thereover since air intermixes with the granulated rubber during the spraying process, resulting in the layer of granulated rubber being porous.

SUMMARY

Accordingly, there is a need for a simpler waterproofing system and method for transportation structures, such as railway structures (e.g., railroad bridge decks) that do not require specialized equipment or us filler material (e.g., granulated rubber). In one example, a protection layer is used to provide a protective layer between the waterproofing membrane and ballast.

In some aspects, the techniques described herein relate to a waterproofing structure for a railway structure, including: a waterproof membrane configured to be applied over a bed of the railway structure; and a membrane protection layer configured to be applied over the waterproof membrane, the membrane protection layer excluding a filler material.

In some aspects, the techniques described herein relate to a railway structure, including: a bed including a material chosen of a group consisting of, concrete, steel, wood or timber, and brick, and a combination of concrete and steel; and a waterproofing structure disposed over the bed, the waterproofing structure consisting of: a waterproof membrane disposed over the bed, and a membrane protection layer disposed over the waterproof membrane, the membrane protection layer excluding a filler material.

In some aspects, the techniques described herein relate to a method for waterproofing a railway structure, including: applying a waterproof membrane over a bed of the railway structure; and applying a membrane protection layer over the waterproof membrane, the membrane protection layer excluding a filler material.

DETAILED DESCRIPTION

Figure 1:
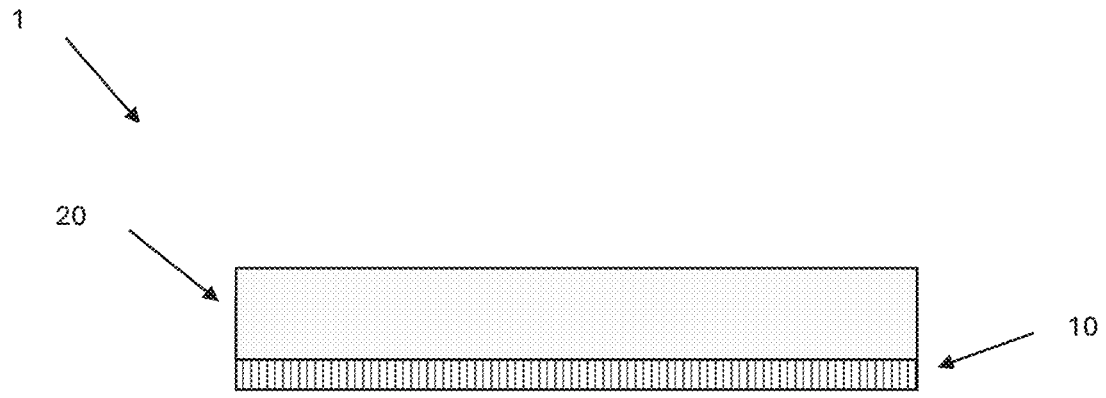
FIG. 1 is a schematic cross-sectional view of a waterproofing structure.

FIG. 1 shows a waterproofing structure 1 for use on a transportation structure, such as railway structures, which can be for example railroad bridge decks (e.g. made of concrete or steel). The waterproofing structure 1 includes a waterproof membrane 10 and a membrane protection layer 20. The waterproof membrane 10 can be, for example, an elastomeric coating that can be applied (e.g., with a hose and spray gun) as one or more liquid coatings or layers and that cures to form a waterproof barrier. In one example, the elastomeric coating can be polyurea. In one example, the waterproof membrane 10 can have a thickness of between about 50 mils and about 150 mils (e.g., between 0.050 inches and 0.150 inches), such as between about 80 mils and about 120 mils (e.g., between 0.080 inches and 0.120 inches).

The membrane protection layer 20 can be spray applied elastomeric foam that is fast setting, rapid curing, flexible and impact resistant. In one example, the membrane protection layer 20 is a spray applied polyurea foam that is flexible and impact resistant. In one example, the membrane protection layer 20 is a single layer (e.g., does not require application of multiple layers). In one example, the spray applied polyurea foam can have a gel time of about 7 seconds (at 68° F. using ASTM D1640 standard) and a tack free time of about 16 seconds (at 68° F. using ASTM D1640 standard), a shore hardness of greater than 55A (using ASTM D2240 standard), a tensile strength of greater than 300 psi (using ASTM D412 standard) and an elongation of greater than 75% (using ASTM D412 standard). The spray applied polyurea foam can have zero volatile organic compounds (VOCs). In one example, the membrane protection layer 20 can have a minimum thickness of between about 150 mils and about 200 mils (e.g., between 0.250 inches and 0.200 inches), such as a minimum thickness of at least about 170 mils (0.170 inches), and meets the American Railway Engineering and Maintenance-of-way Association (AREMA) Ballast Impact Test (e.g., meets the AREMA Ballast Impact Test specified in the 2022 AREMA Manual for Railway Engineering, which can be found in Chapter 8, part 29.9.10d).

Figure 2:
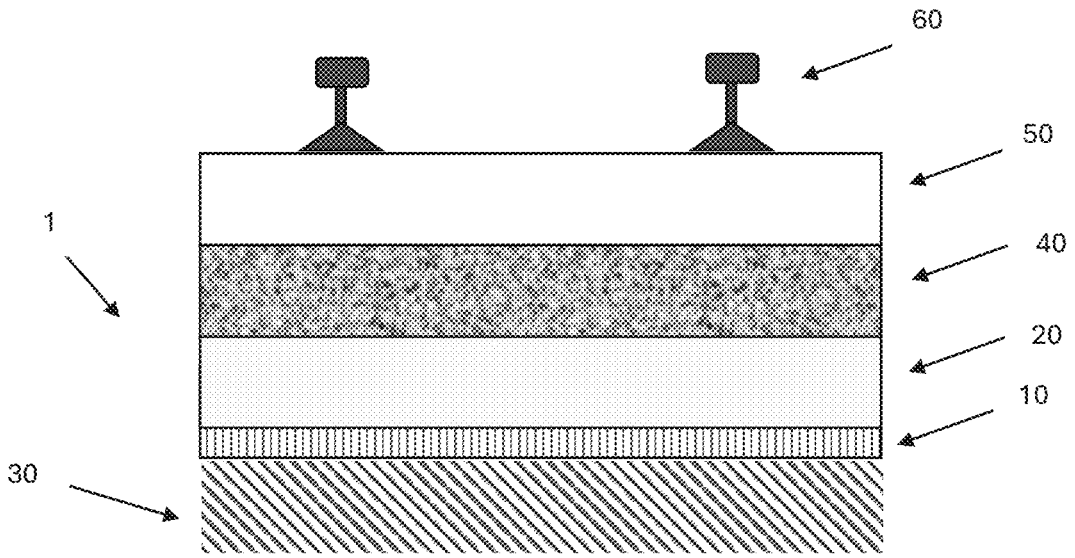
FIG. 2 is a schematic cross-sectional view of the waterproofing structure installed in a railway structure.

FIG. 2 shows the waterproofing structure 1 installed in a transportation structure, for example a railway structure. The waterproof membrane 10 can be applied (e.g., sprayed, uniformly applied) over or onto at least a portion of (e.g., all of, less than all of) a bed 30 to provide a liquid tight seal thereon. The bed 30 can be concrete, steel, timber or wood, brick or a combination of these (e.g., concrete and steel). In one example the railway structure is a railroad bridge deck.

The membrane protection layer 20 can be applied (e.g., sprayed, uniformly applied) onto or over the waterproof membrane 10, as discussed above. A ballast 40 is applied or disposed over the membrane protection layer 20. The ballast 40 is made of rock (e.g., crushed granite). Railway ties 50 are applied or disposed over the ballast 40, and rails 60 are disposed over the railway ties 50. In some examples, a primer layer is applied (e.g., sprayed) to or disposed on the bed 30 before application of the waterproof membrane 10 is applied. The primer can in some examples be made of epoxy or urethane. However, the primer can be made of other suitable materials. The primer layer can advantageously facilitate adherence of the waterproof membrane 10 over the bed 30 to provide a watertight seal over the bed 30. Advantageously, the membrane protection layer 20 excludes (e.g., does not require) a filler material (e.g., rubber granules) intermixed with the elastomeric foam material. Advantageously, the waterproofing structure 1 excludes (e.g., does not require) a sealing layer applied over the membrane protection layer 20.

Figure 3:
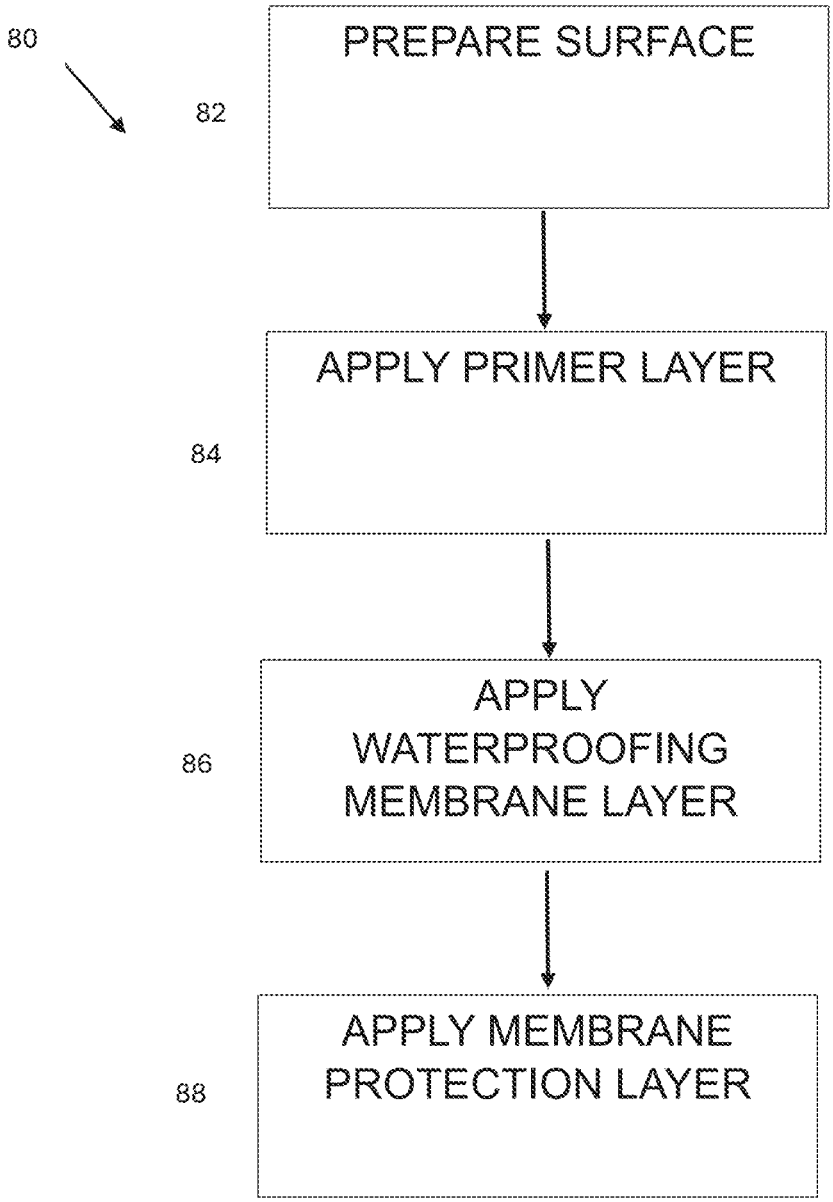
FIG. 3 is a flowchart illustrating a method of waterproofing a railway structure.

FIG. 3 shows a method 80 of forming or applying a waterproof structure, for example on a railway structure (e.g., railroad bridge deck) or other transportation structure. The method 80 includes the step 82 of preparing the surface (e.g., of the bed onto which the waterproof structure will be applied). The method 80 includes the step 84 of applying a primer layer on the underlying surface (e.g., a concrete surface). This step is optional if the underlying surface is steel. The method 80 includes the step 86 of applying the waterproofing membrane layer (e.g., waterproof membrane layer 10 described above). The method incudes the step 86 of applying the membrane protection layer (e.g., the membrane protection layer 20 described above) over the waterproof membrane layer, where the membrane protection layer and waterproof membrane layer form the waterproof structure.

Additional Embodiments

In embodiments of the present disclosure, a waterproofing structure for a railway structure, railway structure and method for waterproofing a railway structure may be in accordance with any of the following clauses:

Clause 1. A waterproofing structure for a railway structure, comprising: a waterproof membrane configured to be applied over a bed of the railway structure; and a membrane protection layer configured to be applied over the waterproof membrane, the membrane protection layer excluding a filler material.

Clause 2. The waterproofing structure of Clause 1, wherein the membrane protection layer has a thickness greater than a thickness of the waterproof membrane.

Clause 3. The waterproofing structure of Clause 2, wherein the waterproof membrane has a thickness of between about 0.050 inches and 0.150 inches.

Clause 4. The waterproofing structure of Clause 3, wherein the membrane protection layer has a minimum thickness of about 0.170 inches.

Clause 5. The waterproofing structure of any preceding clause, wherein the waterproof membrane is a polyurea coating.

Clause 6. The waterproofing structure of any preceding clause, wherein the membrane protection layer is a polyurea foam.

Clause 7. The waterproofing structure of any preceding clause, wherein the membrane protection layer is a single layer.

Clause 8. A railway structure, comprising: a bed comprising a material chosen of a group consisting of, concrete, steel, wood or timber, and brick, and a combination of concrete and steel; and a waterproofing structure disposed over the bed, the waterproofing structure consisting of: a waterproof membrane disposed over the bed, and a membrane protection layer disposed over the waterproof membrane, the membrane protection layer excluding a filler material.

Clause 9. The railway structure of Clause 8, wherein the membrane protection layer has a thickness greater than a thickness of the waterproof membrane.

Clause 10. The railway structure of Clause 9, wherein the waterproof membrane has a thickness of between about 0.050 inches and 0.150 inches.

Clause 11. The railway structure of Clause 10, wherein the membrane protection layer has a minimum thickness of about 0.170 inches.

Clause 12. The railway structure of any of Clauses 8-11, wherein the waterproof membrane is a polyurea coating.

Clause 13. The railway structure of any of Clauses 8-12, wherein the membrane protection layer is a polyurea foam.

Clause 14. The railway structure of any of Clauses 8-13, wherein the membrane protection layer is a single layer.

Clause 15. The railway structure of any of Clauses 8-14, further comprising a primer layer disposed between the waterproof membrane and the bed.

Clause 16. A method for waterproofing a railway structure, comprising: applying a waterproof membrane over a bed of the railway structure; and applying a membrane protection layer over the waterproof membrane, the membrane protection layer excluding a filler material.

Clause 17. The method of Clause 16, wherein applying the membrane protection layer includes spraying a polyurea foam over the waterproof membrane.

Clause 18. The method of Clause 17, wherein spraying the polyurea foam over the waterproof membrane consists of spraying a single layer of the polyurea foam over the waterproof membrane, the single layer having a minimum thickness of 0.170 inches.

Clause 19. The method of Clause 18, wherein applying the waterproof membrane comprises applying a liquid polyurea coating having a thickness of between about 0.050 inches and 0.150 inches.

Clause 20. The method of any of Clauses 16-19, further comprising applying a primer layer over the bed of the railway structure prior to applying the waterproof membrane.

While certain embodiments of the invention have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Of course, the foregoing description is that of certain features, aspects and advantages of the present invention, to which various changes and modifications can be made without departing from the spirit and scope of the present invention. Moreover, the devices described herein need not feature all of the objects, advantages, features and aspects discussed above. Thus, for example, those of skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of these specific features and aspects of embodiments may be made and still fall within the scope of the invention. Accordingly, it should be understood that various features and aspects of the disclosed embodiments can be combined with or substituted for one another in order to form varying modes of the discussed devices.

What is claimed is:

1. A waterproofing structure for a railway structure, comprising:

a waterproof membrane configured to be applied over a bed of the railway structure; and a membrane protection layer configured to provide a uniform non-porous layer over the waterproof membrane, the membrane protection layer providing waterproofing protection to the waterproof membrane and comprising a single elastomeric material excluding a filler material.

2. The waterproofing structure of claim 1, wherein the membrane protection layer has a thickness greater than a thickness of the waterproof membrane.

3. The waterproofing structure of claim 2, wherein the waterproof membrane has a thickness of between about 0.050 inches and 0.150 inches.

4. The waterproofing structure of claim 3, wherein the membrane protection layer has a minimum thickness of about 0.170 inches.

5. The waterproofing structure of claim 1, wherein the waterproof membrane is a polyurea coating.

6. The waterproofing structure of claim 1, wherein the membrane protection layer is a polyurea foam.

7. The waterproofing structure of claim 1, wherein the membrane protection layer is a single layer.

8. A railway structure, comprising:

a bed comprising a material chosen of a group consisting of, concrete, steel, wood or timber, and brick, and a combination of concrete and steel; and a waterproofing structure disposed over the bed, the waterproofing structure consisting of:

a waterproof membrane disposed over the bed, and a membrane protection layer configured to provide a uniform non-porous layer disposed over the waterproof membrane, the membrane protection layer providing waterproofing to the waterproof membrane and comprising a single elastomeric material excluding a filler material.

9. The railway structure of claim 8, wherein the membrane protection layer has a thickness greater than a thickness of the waterproof membrane.

10. The railway structure of claim 9, wherein the waterproof membrane has a thickness of between about 0.050 inches and 0.150 inches.

11. The railway structure of claim 10, wherein the membrane protection layer has a minimum thickness of about 0.170 inches.

12. The railway structure of claim 8, wherein the waterproof membrane is a polyurea coating.

13. The railway structure of claim 8, wherein the membrane protection layer is a polyurea foam.

14. The railway structure of claim 8, wherein the membrane protection layer is a single layer.

15. The railway structure of claim 8, further comprising a primer layer disposed between the waterproof membrane and the bed.

16. A method for waterproofing a railway structure, comprising:

applying a waterproof membrane over a bed of the railway structure; and applying a membrane protection layer over the waterproof membrane, the membrane protection layer configured to provide a uniform non-porous layer over the waterproof membrane, the membrane protection layer providing waterproofing to the waterproof membrane and comprising a single elastomeric material excluding a filler material.

17. The method of claim 16, wherein applying the membrane protection layer includes spraying a polyurea foam over the waterproof membrane.

18. The method of claim 17, wherein spraying the polyurea foam over the waterproof membrane consists of spraying a single layer of the polyurea foam over the waterproof membrane, the single layer having a minimum thickness of 0.170 inches.

19. The method of claim 18, wherein applying the waterproof membrane comprises applying a liquid polyurea coating having a thickness of between about 0.050 inches and 0.150 inches.

20. The method of claim 16, further comprising applying a primer layer over the bed of the railway structure prior to applying the waterproof membrane.

* * * * *